US008070011B2

(12) United States Patent
Fukano

(10) Patent No.: US 8,070,011 B2
(45) Date of Patent: Dec. 6, 2011

(54) GLASS PACKAGING COVER

(75) Inventor: Isabel Satiko Fukano, Sao Paulo (BR)

(73) Assignee: Dixie Toga S/A, Sao Paulo (BR)

( * ) Notice: Subject to any disclaimer, the term of this patent is extended or adjusted under 35 U.S.C. 154(b) by 396 days.

(21) Appl. No.: 12/113,531

(22) Filed: May 1, 2008

(65) Prior Publication Data

US 2008/0272123 A1 Nov. 6, 2008

(30) Foreign Application Priority Data

May 2, 2007 (BR) ..... 8701038 U

(51) Int. Cl.
*B65D 41/18* (2006.01)
*B65D 51/16* (2006.01)

(52) U.S. Cl. ..... 220/780; 220/367.1

(58) Field of Classification Search ..... 220/780, 220/781, 367.1, 714, 713, 711, 203.29, 203.01, 220/202, FOR. 100, 703, 694; 215/307, 215/200, 387; D9/392.1, 511, 510; *B65D 41/18, B65D 41/16, 51/16*

See application file for complete search history.

(56) References Cited

U.S. PATENT DOCUMENTS

| | | | | | |
|---|---|---|---|---|---|
| 3,912,118 | A * | 10/1975 | Bird | 206/508 |
| 4,508,235 | A * | 4/1985 | Steele et al. | 215/307 |
| D358,294 | S * | 5/1995 | Letica | D7/392.1 |
| 5,890,621 | A * | 4/1999 | Bachman et al. | 220/717 |
| 5,894,952 | A * | 4/1999 | Mendenhall et al. | 220/713 |
| 6,357,619 | B1 * | 3/2002 | Schaefer | 220/709 |
| 6,374,726 | B1 * | 4/2002 | Melton | 99/323 |
| 2007/0114202 | A1 * | 5/2007 | Lee | 215/311 |

* cited by examiner

*Primary Examiner* — Mickey Yu
*Assistant Examiner* — Robert J Hicks
(74) *Attorney, Agent, or Firm* — Arent Fox LLP

(57) ABSTRACT

A cover to be attached to a container having a mouth defined at an open end thereof. The cover includes a body having a plane surface defined at an upper end thereof and which is connected to a flap defined at a lower end of the body for sealingly engaging the mouth of the container. A semi-spherical shaped expansion chamber is positioned between and connecting the plane surface and the flap, and an inner trunk-conic wall abuts the plane surface and extends way from the plane surface and toward the mouth of the container. The inner trunk-conic wall terminates at a bottom wall, wherein the bottom wall extends transverse relative to a longitudinal axis of the cover; and an exhaust hole is defined in the bottom wall.

3 Claims, 2 Drawing Sheets

GLASS PACKAGING COVER

CROSS-REFERENCE TO RELATED APPLICATION

This application claims the priority of Brazilian Application No. MU8701038-0, filed May 2, 2007 the entire specification, claims and drawings of which are incorporated herewith by reference.

BACKGROUND OF THE INVENTION

1. Field of the Invention

The present invention relates to a cover for packagings, and in particular to a glass cover for gasified beverages that prevent leaks.

2. Brief Description of Related Art

Plastic packaging is well known for gasified beverages, such as, for example, a soft drink, wherein the packaging includes a glass that receives the beverage, and a cover that is fixed to the mouth of the glass to prevent the beverage from spilling or leaking therefrom. Such known glass packaging is used in, for example only, luncheonettes, restaurants, home meal delivery service (delivery) and others, where the glass receives the beverage and is then closed or sealed therein by the cover before the assembly is transported to a place for consumption.

Although the above-described conventional packaging is useful for the discussed purpose, the packaging is somewhat inconvenient in that the cover is flat. As a result of the normal expansion of gases from the gasified beverages therein, and the lack of a relief mechanism, the interstice between the cover and the glass opens or separates such that a leak or spillage occurs.

In yet another conventional packaging, there is a cover having a substantially semi-spherical body provided, on a lower border thereof, with a coupling flap. The cover is fixed to a mouth of the glass and, on an upper border, the cover has a plane equipped with a centrally located groove at the bottom of which is provided a hole for introduction of a straw. The cover also includes a self-adhesive label that may be removed from the hole to provide access to the hole and is equipped with micro-openings that provide the function of a relief valve.

In spite of favorable results obtained with the aforementional conventional packaging, there has been numerous efforts by those in the industry to improve the packaging.

SUMMARY OF THE INVENTION

An aspect of the present invention is to provide a cover having a semi-spherical body provided with a lower coupling flap and which is fixed to, on or about a mouth of a glass. The cover body is provided with an upper plane from which a central, inner trunk-conic wall extended inwards toward a holding chamber of the glass or beverage container. The inner trunk-conic wall connects the upper plane to a base having an exhaust hole defined therein and having a diameter with a size that is selected to facilitate exhausting the gases from the holding chamber of the glass to the environment at a predetermined, and preferably low, speed or rate.

Thus, during transport, if the glass or container is holding a soft drink, the gases from the soft drink will hit or strike, from the holding chamber portion of the glass or container, the inner or bottom surface of the cover corresponding to the region having the trunk-conic wall. Then, the gas expands along the inner or bottom surface of the cover body corresponding to the expansion chamber is drained or exhausted from or through the exhaust hole and into the atmosphere. As such, the cover does not separate from the glass or container, thereby preventing or avoiding the interstices between the glass and cover from opening, and preventing any spillage or leakage therefrom. Because the gas is exhausted through the exhaust hole at a relatively low speed, such that there is not enough or an insufficient amount of drag force generated that would lift drops of the beverage through the exhaust hole, thereby avoiding any leaks.

The cover of the present invention avoids the leaks that occur in the above-described conventional covers.

The cover of the present invention also avoid the need for using a self-adhesive relief valve.

The cover of the present invention, besides the advantages described above, provides a structural arrangement that is interesting, easier to manufacture and costs less.

BRIEF DESCRIPTION OF DRAWINGS

The present invention is illustrated in the attached drawings, in which:

Referring to FIG. 2, the cover 10 of the present invention is fixed or otherwise attached to a packaging, which is, in the illustrated example, a glass 1 which receives a gasified beverage 50 therein. The cover 10 closes the mouth of the glass 1, and includes at a lower end of the cover body with a flap 11 that is removably fixed to the ferrule 2 of the glass 1. The flap 11 is configured to define at least a sealing surface against an inner surface of the glass 1 to help prevent the beverage from leaking between the ferrule 2 and the flap 11.

Preferably, the cover 10 has a substantially semi-spherical shape that defines an expansion chamber 12 extending between the flap 11 and an upper plane surface 13, The expansion chamber 12 is configured to receive, hold and then guide the gases 51 released by the gasified beverage 50. As shown in FIG. 1, an outer edge of the upper plane 13 abuts an upper edge of the expansion chamber 12 while an inner or central edge of the upper plane 13 abuts or transitions to the inner trunk-conic wall 14, which extends generally in a downward or sloped direction away from the inner or central edge of the upper plane 13 and towards the holding chamber of the glass 1. As shown in FIG. 2, the inner trunk-conic wall 14 terminates at a bottom wall 15 that is intermediate relative to the upper plane 13 and flap 11 of the cover 1. Although not limited thereto, the bottom wall 14 extends in a generally horizontal direction that is orthogonal relative to a longitudinal axis of the cover 1. As shown in FIG. 1, an exhaust hole 16 is defined in the bottom wall 15, preferably in a centrally located region thereof, and has a diameter that is sized to exhaust the gases 51 from the beverage 50 at a relatively low speed, thereby providing an insufficient drag force that would lift drops of the beverage toward the hole 16.

Figure 1:
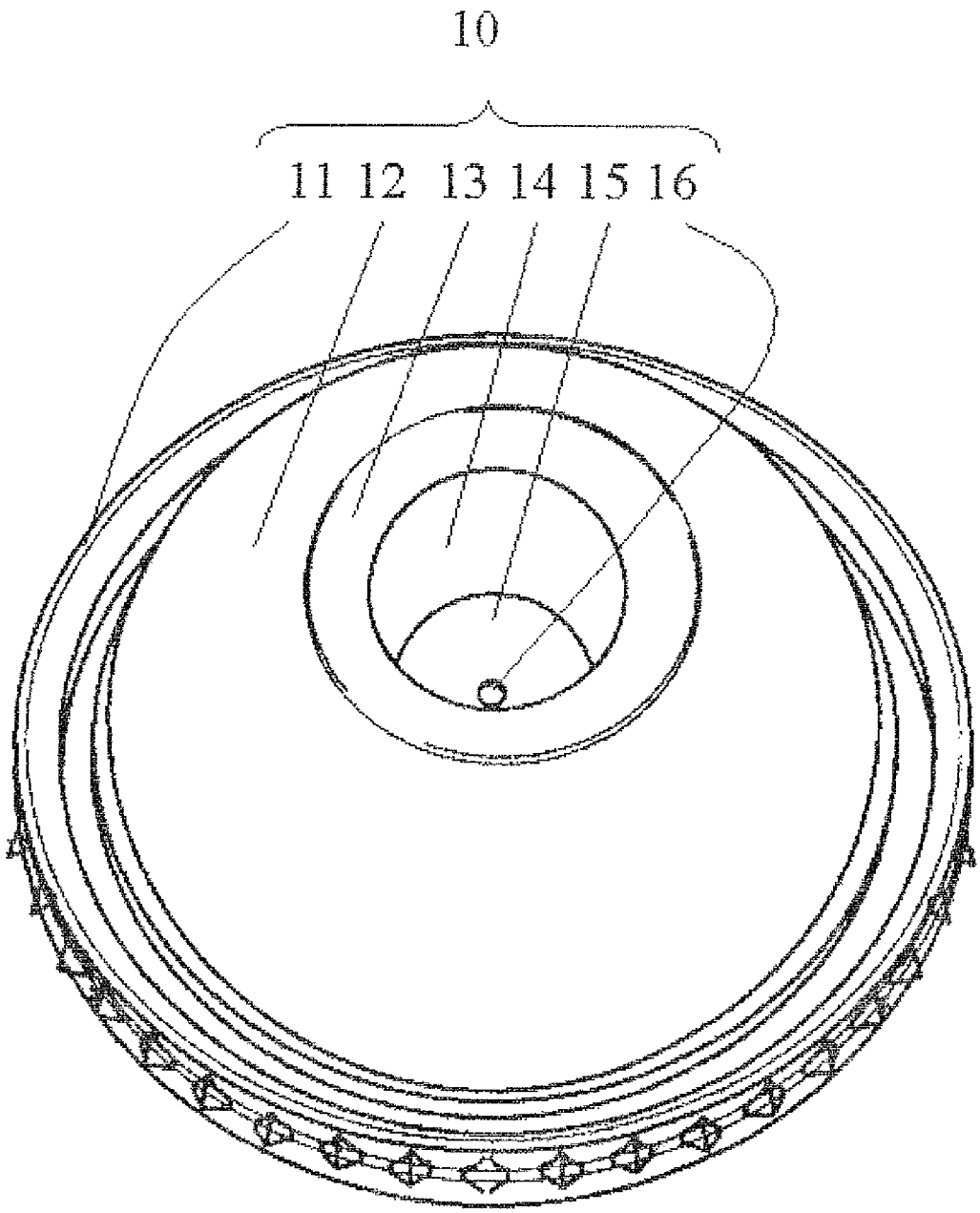
FIG. 1 shows a top, perspective view of the cover according to a preferred embodiment of the invention.
Figure 2:
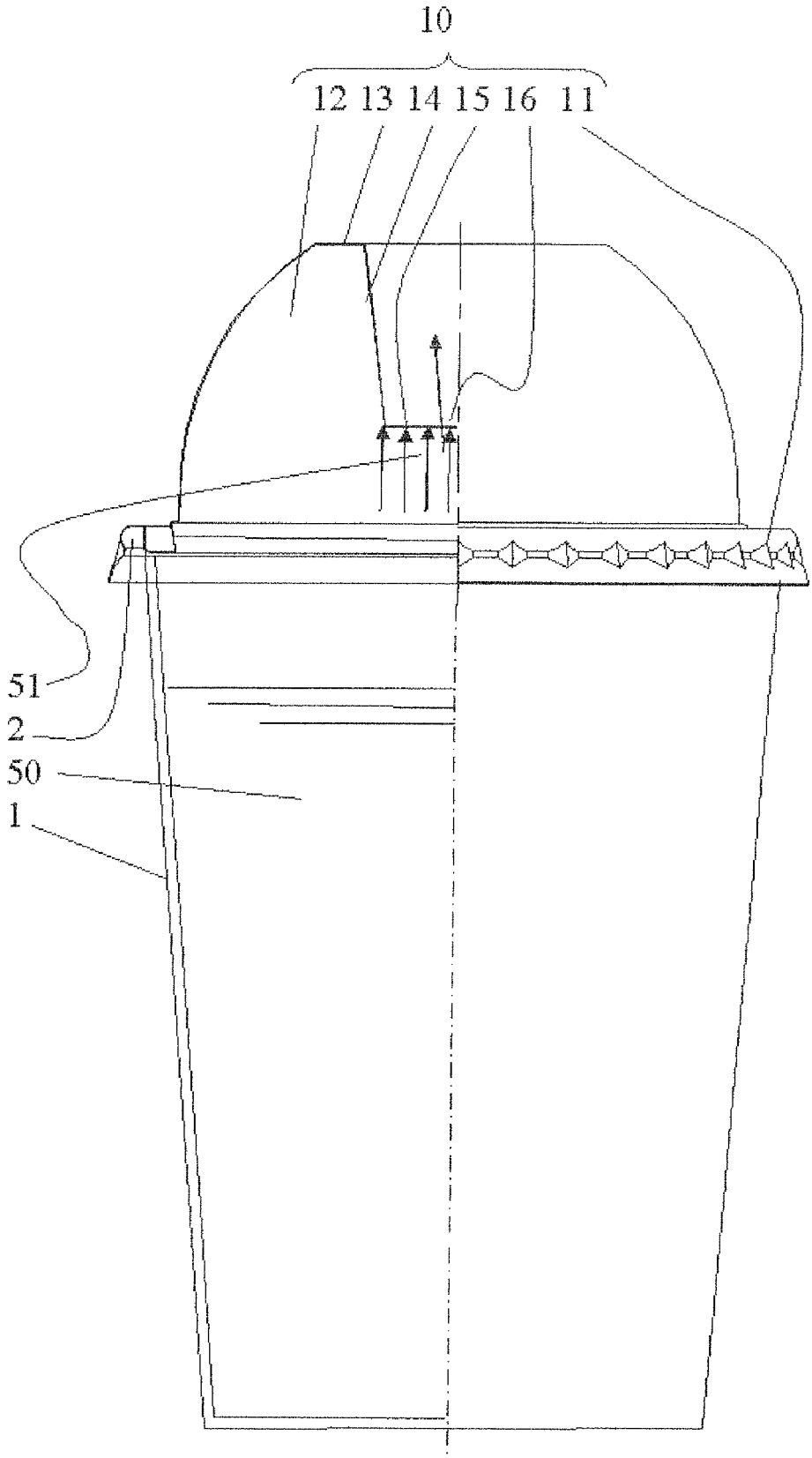
FIG. 2 shows a partial, cross-sectional view of the cover shown in FIG. 1 attached to a packaging glass.

Preferably, the cover 10 is manufactured from a suitable material, such as, for example, a thermoformed plastic, e.g., polypropylene, polystyrene, PET, PVC, and the like.

Thus, after the glass 1 is filled with the gasified beverage 50, the cover 10 is applied on a mouth of the glass 1 such that the ferrule 2 of the glass 1 and the flap 11 of the cover 10 are fixed to each other and form or otherwise define a seal.

Under these conditions, the glass 1 defines a packaging medium for the gasified beverage 50, and the expansion chamber 12 of the cover 10 provides a mechanism through which the gas 51 released by the beverage is exhausted via the hole 16 at a relatively low speed that is adequate enough to avoid lifting any drops of the beverage toward the hole 16. As such, the present invention provides a mechanism that is adequate for reliably transporting the assembly of the glass 1 and cover 10 without the risk of leakages.

Although the present invention has been described with reference to a preferred embodiment, it is to be understood that the invention is not limited to the details thereof. A number of possible modifications and substitutions will occur to those of ordinary skill in the art, and all such modifications and substitutions are intended to fall with the scope of the invention as defined in the appended claims.

I claim:

1. A cover to be attached to a container having a mouth defined at an open end thereof, the cover comprising:

a body having a plane surface defined at an upper end thereof and which is connected to a flap defined at a lower end of the body for sealingly engaging the mouth of the container;

a continuously semi-spherical shaped expansion chamber disposed between and directly connecting the plane surface to the flap, wherein an upper edge of the expansion chamber abuts an outer edge of the plane surface and a lower edge of the expansion chamber abuts the flap;

an inner trunk-conic wall abutting the plane surface and extending away from the plane surface and toward the mouth of the container, the inner trunk-conic wall terminating at a bottom wall, wherein the bottom wall extends transverse relative to a longitudinal axis of the cover and is located closer to the flap than the plane surface defined at the upper end of the body; and an exhaust hole defined in the bottom wall, wherein an area of the exhaust hole is less than an area of the bottom wall to exhaust gases therefrom at a relatively low speed to provide an insufficient drag force that would lift drops of a beverage within the container toward the exhaust hole.

2. The cover according to claim 1, wherein the cover is manufactured from a thermoformed plastic.

3. The cover according to claim 2, wherein the thermoformed plastic is at least one of polypropylene, polystyrene, PET, and PVC.

* * * * *

UNITED STATES PATENT AND TRADEMARK OFFICE

CERTIFICATE OF CORRECTION

PATENT NO. : 8,070,011 B2
APPLICATION NO. : 12/113531
DATED : December 6, 2011
INVENTOR(S) : Isabel Satiko Fukano It is certified that error appears in the above-identified patent and that said Letters Patent is hereby corrected as shown below:

On the Title Page, item (30), should read as follows:

-- (30) May 2, 2007 (BR).....MU 8701038 --

Signed and Sealed this
Twenty-fifth Day of September, 2012

David J. Kappos

David J. Kappos
*Director of the United States Patent and Trademark Office*